US005601500A

United States Patent [19]

Shipley

[11] Patent Number: 5,601,500

[45] Date of Patent: Feb. 11, 1997

[54] GOLF PUTTER HEAD

[76] Inventor: Barry E. Shipley, 17/77 Rosalind St., Cammeray, NSW 2067, Australia

[21] Appl. No.: 325,295

[22] PCT Filed: May 6, 1993

[86] PCT No.: PCT/AU93/00203

§ 371 Date: Nov. 3, 1994

§ 102(e) Date: Nov. 3, 1994

[87] PCT Pub. No.: WO93/22008

PCT Pub. Date: Nov. 11, 1993

[30] Foreign Application Priority Data

May 6, 1992 [AU] Australia ..... PL2282

[51] Int. Cl.[6] ..... A63B 53/04

[52] U.S. Cl. ..... 473/314; 473/325; 473/340; 473/345

[58] Field of Search ..... 273/167 R, 77 R, 273/167 B, 167 D, 167 C, 168, 79, 78, 169, 167 F; 473/313, 314, 325, 340, 345, 251

[56] References Cited

U.S. PATENT DOCUMENTS

| | | | |
|---|---|---|---|
| 1,154,490 | 9/1915 | Davis | 273/78 |
| 1,343,998 | 6/1920 | Grant | 273/169 |
| 1,467,714 | 9/1923 | Doerr . | |
| 1,568,888 | 1/1926 | Dunn . | |
| 2,174,212 | 9/1939 | Newsome | 273/167 F |
| 2,820,638 | 1/1958 | Morrison | 273/80 C |
| 3,042,405 | 7/1962 | Solheim | 273/78 |
| 3,061,310 | 10/1962 | Giza . | |
| 3,085,804 | 4/1963 | Pieper | 273/167 B |
| 3,923,308 | 12/1975 | Mills | 273/78 |
| 4,795,158 | 1/1989 | Kuydendall | 273/167 B |
| 4,852,879 | 8/1989 | Collins | 273/80 C |
| 4,867,457 | 9/1989 | Lowe | 273/167 B |
| 4,881,739 | 11/1989 | Garcia . | |
| 4,930,781 | 6/1990 | Allen . | |
| 4,962,932 | 10/1990 | Anderson | 273/171 |
| 5,004,241 | 4/1991 | Antonious . | |
| 5,078,398 | 1/1992 | Reed | 273/80 C |
| 5,226,654 | 7/1993 | Solheim | 273/167 F |

FOREIGN PATENT DOCUMENTS

| | | |
|---|---|---|
| 1205098 | 5/1986 | Canada . |
| 0345196 | 12/1989 | European Pat. Off. . |
| 2142248 | 1/1985 | United Kingdom . |

OTHER PUBLICATIONS

The Physics of Ball Games, C. B. Daish, 1972, page 9.

*Primary Examiner*—Sebastiano Passaniti
*Attorney, Agent, or Firm*—Spencer & Frank

[57] ABSTRACT

A golf club head includes a body having a central plane, and a front planar face for striking a golf ball. The front planar face is at a negative angle in the range of 4° to 8° to the central plane so that a bottom edge of the front planar face is closer to the central plane than is a top edge of the front planar face. The center of gravity of the head is substantially aligned with the point on the front planar face which is the point of impact of a golf ball. The golf club head further includes attachment means for attaching a shaft to a top portion of the body parallel to the central plane.

4 Claims, 2 Drawing Sheets

GOLF PUTTER HEAD

FIELD OF THE INVENTION

This invention relates to golf clubs, particularly golf putters and more particularly the head of a golf putter.

BACKGROUND OF THE INVENTION

Golf club heads have a front face which is used to contact the ball to be hit, and thus to exchange energy from the club to the ball. For woods and driving irons the front face is at a positive angle to drive the ball upwards, as well as forwards, when hit. The angles vary from club to club allowing the player to select the desired amount of lift for a particular shot. Putters, for use close to the hole, generally have little or no angle as they are intended to push the ball across the playing surface without any lift. Some players slightly pull their putter upwards as its strikes the ball so as to produce top spin and encourage more run on or distance for the same force.

DISCLOSURE OF THE INVENTION

The present invention provides a putter that has a negative angle on the front face. The front face will normally hit the ball above centre and therefore may produce top spin on the ball without a need to develop a particular putting style. Thus, when hitting the ball with the putter in accordance with this invention, the ball tends to be pushed and rolled, not merely pushed along the playing surface.

Accordingly, a first aspect the present invention consists in a golf club head comprising a body having a central plane, an attachment means for attaching a shaft parallel to the central plane, and a front face for striking a golf ball, the front face being at a negative angle to the central plane so that a bottom edge of the front face is closer to the central plane than is a top edge of the front face and wherein the centre of gravity of the head is substantially aligned with a point of the front face which is the point of impact of a golf ball.

In one form the club head has two opposed front faces, both at equal negative angles so that the body is in the form of a narrow wedge, the narrowest end of the wedge facing vertically downward as it strikes the ball.

In a second aspect, this invention further consists in a golf club head having an attachment means for attaching a shaft thereto and a front face for striking a golf ball characterised in that within the head is disposed a cavity which is dimensioned such that the front face is defined by a relatively thin wall.

In another form, the club head comprises a body having a central plane, an attachment means for attaching a shaft parallel to the central plane, a front face for striking a golf ball, the front face being at a negative angle to the central plane so that a bottom edge of the front face is closer to the central plane than is a top edge of the front face and a fully enclosed chamber disposed within the head, which chamber is dimensioned such that the front face is defined by a relatively thin wall and wherein the centre of gravity of the head is substantially aligned with a point on the front face which is the point of impact of a golf ball.

It is preferred that the negative angle is in the range 4°–8° it is most preferred that it is in the range 5°–7°.

The advantage of the chamber is that it provides a means by which the walls of the front face may be made relatively thin, of the order of 3–5 mm. This thin wall allows a player to achieve a softer sense of contact with the ball. It also extends the "sweet spot".

Of the putters that are currently available with thin walled striking faces, most incorporated a "weighted" sole usually at the back and the lowest point of the club head. This tends to put the club head off-balance with a hook or slice tendency built-in.

However, the club head of the present invention has a shape which is uniform with the bulk of the weight at the top of the blade. Furthermore, the centre of gravity is substantially in the centre and is aligned with a point on the front face which is the point of impact of a golf ball.

Thus the club head of the present invention is perfectly balanced with no hook or slice tendency.

By way of example only, two embodiments of the invention will now be described with reference to the following drawings.

MODES FOR CARRYING OUT THE INVENTION

Figure 1:
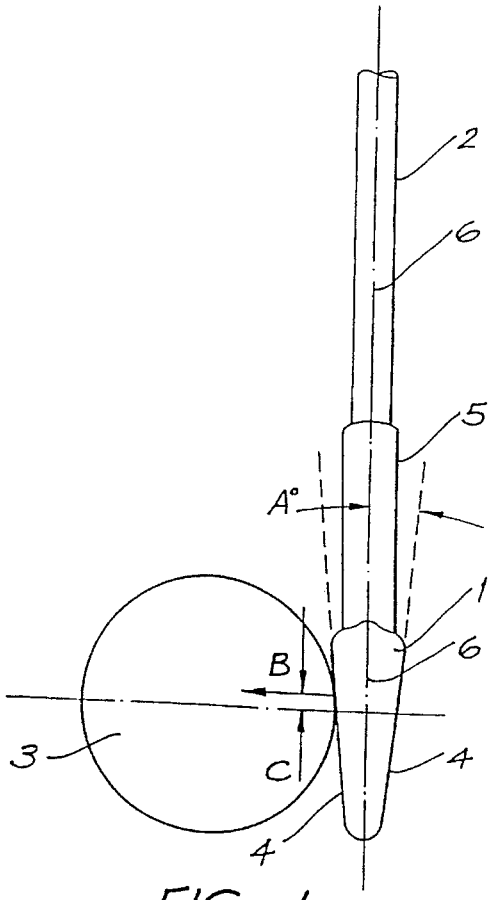
FIG. 1 is a side on view of a club head in accordance with the invention striking a ball.
Figure 2:
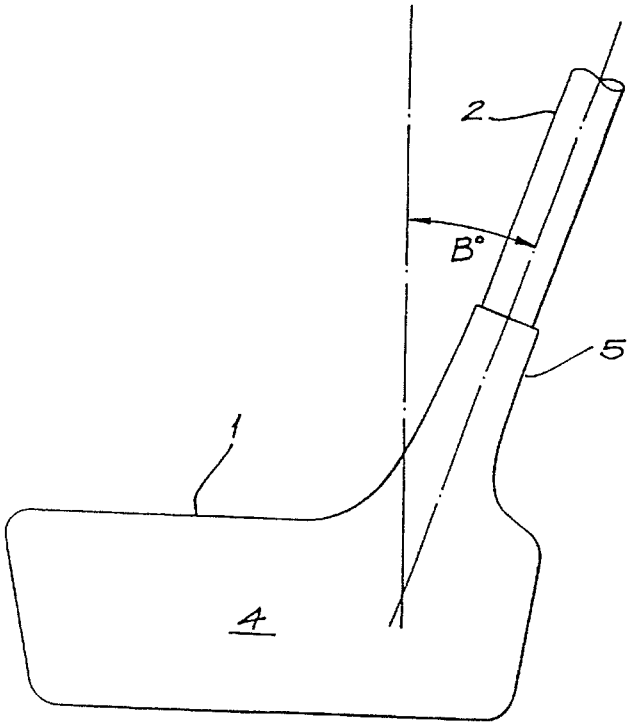
FIG. 2 is a front view of the club head of FIG. 1.
Figure 3:
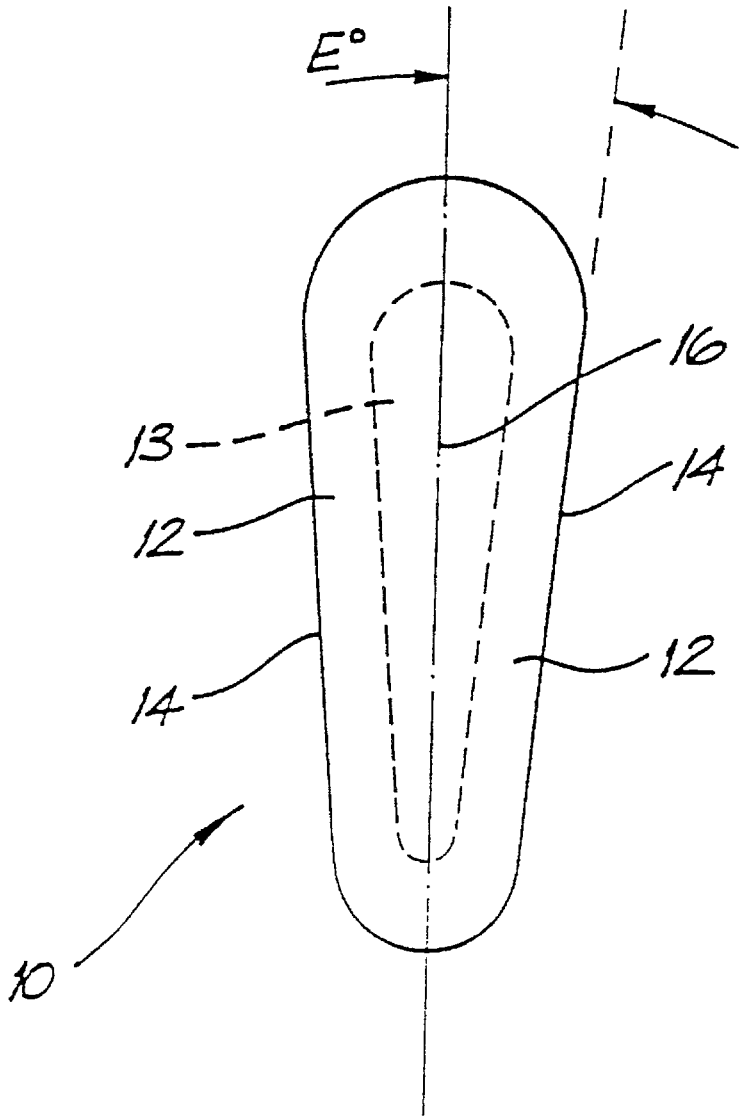
FIG. 3 is a front view of a second embodiment of the club head.

The club head 1 is similar in some regards to a conventional head of a golf putter. It includes a hollow attachment means 5 into which a club shaft 2 is adhered or permanently fixed in some alternative manner. In front view, as shown in FIG. 2, the shaft 2 is at an angle B° to the vertical, the angle being selected according to well known criteria but being generally in the order of 20°. From the side view, as shown in FIG. 1, the shaft 2, as well as the attachment means 5, is generally axially aligned with a central plane 6 of the head 1.

The club head 1 includes a front face 4 which is adapted to strike a ball 3 and to impart a driving force B in order to propel forward the ball 3. In the present invention the club head 1 has a negatively angled, or overhanging, front face 4 which is inclined at an angle A° to the central plane 6 of the head 1. In the embodiment illustrated in FIG. 1, the club can be used by both left and right handed players by virtue of it including two such front faces 4, one on either opposite side of the club head 1. Both faces are at the same negative angle A° to the central plane 6.

Generally the club head 1 strikes the ball 3 at the bottom or lowermost point of the substantially circular arc or swing. At this point, by virtue of the negative angle A between the front face 4 and the central plane 6, the point of impact between the club head 1 and the ball 3, and thus the point of applying the driving force B, is a distance C above the centre-line of the ball 3.

With angle A° equal to 6.5° distance C will be in the order of a few millimeters for a standard golf ball.

With this arrangement a generally conventional putter stroke will result in the ball 3 leaving the head 1 with an initial top spin. For a given force this will result in further distance travelled by the ball 3, and furthermore the ball 3 will have a better tendency of rolling over imperfections in the playing surface.

As with a conventional golf head the corners and edges of the head 1 are slightly radiused although the actual size of the radii is not of significance. Also, the face 4 may be smooth or textured according to the desires of the manufacturer or the user. The head 1 may be produced from any of a number of suitable materials, generally the head 1 may be constructed lighter in weight than a conventional head, although the weight of the head 1 is also generally at the discretion of the manufacturer or ultimate user of the club.

The club head 10 of the second embodiment of the invention is similar to the club head 1 of FIGS. 1 and 2, with the exception that the attachment means is not shown. However, in this embodiment, a fully enclosed chamber 13 is disposed within the head such that the walls 12 of the opposed front face 4 are of the order of 3 mm thick.

As in the first embodiment, faces 14 are negatively angled such that the angle E° formed with central plane 16 is equal to 6.5°.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A golf club putter including: a golf club head having:

a body having a central plane and a front planar face for striking a golf ball, the front planar face being at a negative angle in the range of 4°–8° to the central plane so that a bottom edge of the front planar face is closer to the central plane than is a top edge of the front planar face, and wherein the center of gravity of the head is substantially aligned with a point on the front planar face which is the point of impact with the golf ball; said golf club head having a fully enclosed chamber located therein, the chamber being symmetrically positioned relative to the central plane and dimensioned such that the front planar face is defined by a uniformly, relatively thin wall; a shaft; and attachment means aligned on the central plane for attaching said shaft to a top portion of said body so that said shaft extends upward and generally parallel to the central plane.

2. A putter head having:

an attachment means aligned on a central plane of the putter head for attaching a shaft thereto;

and a body having two opposing front and rear planar faces each of which is for striking a golf ball;

wherein a fully enclosed chamber is symmetrically located within the head and about the central plane, the chamber extending through the head such that the two planar faces are each defined by a uniform relatively thin wall, and wherein the two opposing planar faces are both at equal negative angles in the range of 4°–8° relative to the central plane so that the head forms a wedge with the narrowest end of the wedge facing vertically downward as the head strikes the golf ball.

3. A putter head as defined in claim 2, wherein each of the walls is 3–15 mm thick.

4. A putter head as defined in claim 3, wherein each of the walls is about 3 mm thick.

* * * * *

UNITED STATES PATENT AND TRADEMARK OFFICE

CERTIFICATE OF CORRECTION

PATENT NO. : 5,601,500

DATED : February 11, 1997

INVENTOR(S) : Barry Edwin SHIPLEY

It is certified that error appears in the above-indentified patent and that said Letters Patent is hereby corrected as shown below:

In claim 3, the range "3-15" should be -- 3-5 --.

Signed and Sealed this

Nineteenth Day of August, 1997

*Attest:*

*Attesting Officer*

BRUCE LEHMAN

*Commissioner of Patents and Trademarks*